US009394125B2

(12) United States Patent
Kobayashi

(10) Patent No.: US 9,394,125 B2
(45) Date of Patent: Jul. 19, 2016

(54) PRINT MEDIUM FEED UNIT AND IMAGE FORMATION APPARATUS

(71) Applicant: Oki Data Corporation, Tokyo (JP)

(72) Inventor: Takashi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/828,617

(22) Filed: Aug. 18, 2015

(65) Prior Publication Data

US 2016/0137439 A1 May 19, 2016

(30) Foreign Application Priority Data

Nov. 19, 2014 (JP) ..... 2014-234397

(51) Int. Cl.

| | |
|---|---|
| ***G03G 15/00*** | (2006.01) |
| ***G03G 21/00*** | (2006.01) |
| ***B65H 5/06*** | (2006.01) |
| ***B65H 3/06*** | (2006.01) |

(52) U.S. Cl.

CPC ..... *B65H 3/0638* (2013.01); *B65H 3/0669* (2013.01); *B65H 3/0684* (2013.01); *B65H 5/068* (2013.01); *G03G 15/6529* (2013.01)

(58) Field of Classification Search

CPC ..... G03G 15/00; G03G 21/00; B65H 5/00; B65H 5/06; B65H 1/00; B65H 3/00; B65H 3/06

USPC ..... 399/361–393; 271/3.14, 8.1

See application file for complete search history.

(56) References Cited

U.S. PATENT DOCUMENTS

| | | | | |
|---|---|---|---|---|
| 2007/0145666 | A1* | 6/2007 | Nishikata | B65H 3/0638 271/18 |
| 2009/0295069 | A1* | 12/2009 | Shiina | G03G 15/6511 271/126 |
| 2014/0319756 | A1* | 10/2014 | Hirahara | B65H 3/0684 271/117 |

FOREIGN PATENT DOCUMENTS

| | | | | |
|---|---|---|---|---|
| JP | 2003-201045 A | | 7/2003 | |
| JP | 2004256287 A | * | 9/2004 | G03G 15/00 |
| JP | 2007176621 A | * | 7/2007 | B65H 3/06 |

* cited by examiner

*Primary Examiner* — Nguyen Ha
(74) *Attorney, Agent, or Firm* — Mots Law, PLLC

(57) ABSTRACT

A print medium feed unit includes: a first feed roller including a first end portion and a second end portion and configured to pick up a print medium by rotating about a rotational axis extending in a first direction; a first support portion configured to rotationally support the first end portion; and a second support portion configured to rotationally support the second end portion. At least one of the first support portion and the second support portion includes a separation structure including a first portion and a second portion which are separable from each other in a radial direction of the first feed roller.

20 Claims, 10 Drawing Sheets

PRINT MEDIUM FEED UNIT AND IMAGE FORMATION APPARATUS

CROSS REFERENCE TO RELATED APPLICATIONS

This application claims priority based on 35 USC 119 from prior Japanese Patent Application No. 2014-234397 filed on Nov. 19, 2014, entitled "PRINT MEDIUM FEED UNIT AND IMAGE FORMATION APPARATUS", the entire contents of which are incorporated herein by reference.

BACKGROUND OF THE INVENTION

1. Field of the Invention

The disclosure relates to a print medium feed unit configured to feed a print medium, and an image formation apparatus including the print medium feed unit.

2. Description of Related Art

Conventional image formation apparatuses configured to form images on print media, for example, by electrophotography, use a print medium feed unit configured to feed the print media to an image formation section on a one-by-one basis (see Japanese Patent Application Publication No. 2003-201045).

SUMMARY OF THE INVENTION

A feed roller configured to send the print medium in a predetermined direction is installed in the print medium feed unit. The feed roller needs to be replaced for various reasons, such as abrasion due to the use.

An object of the disclosure is to provide a print medium feed unit which enables a feed roller to be replaced easily, and which is capable of sending a print medium appropriately; and an image formation apparatus including the print medium feed unit.

An aspect of the invention is a print medium feed unit that includes: a first feed roller including a first end portion and a second end portion, and configured to pick up a print medium by rotating about a rotational axis extending in a first direction; a first support portion configured to rotationally support the first end portion; and a second support portion configured to rotationally support the second end portion. At least one of the first support portion and the second support portion includes a separation structure including a first portion and a second portion which are separable from each other in a radial direction of the first feed roller.

According to an aspect of the invention, the first feed roller can be replaced easily, and the print medium can be sent appropriately.

DETAILED DESCRIPTION OF THE EMBODIMENTS

Figure 1:
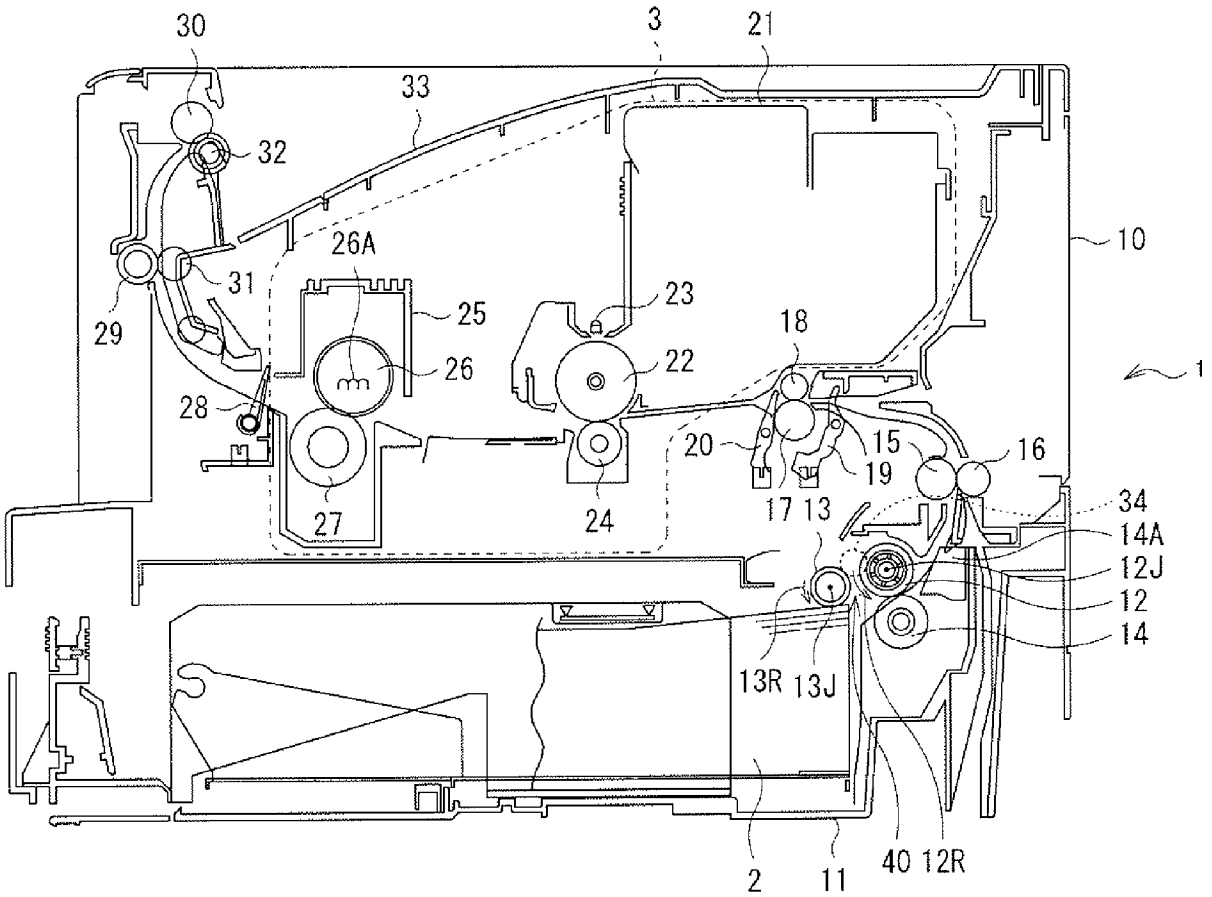
FIG. 1 is a schematic diagram illustrating an example of an overall configuration of an image formation apparatus of an embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

In addition, the invention is not limited to the arrangements, dimensions and dimensional ratios of components illustrated in the drawings. The descriptions are provided in the following sequence:

1. the embodiment, an image formation apparatus including a print medium feed unit which is provided with a pickup feeder roller and a transfer feeder roller for their respective functions, and
2. a modification.

1. Embodiment

Schematic Configuration

FIG. 1 is a schematic diagram illustrating an example of an overall configuration of image formation apparatus 1 of the embodiment of the invention. Image formation apparatus 1 is an electrophotographic printer configured to form an image (for example, a monochrome image) on a print medium (also referred to as a record medium, or a transfer material) such as a sheet.

Inside housing 10, image formation apparatus 1 includes: image formation section 3 configured to transfer an image onto print medium 2, for example; and a print medium feed unit situated upstream of image formation section 3, and configured to feed print medium 2 to image formation section 3. It should be noted that: the description defines "upstream" as situated closer to sheet feeder tray 11 (later described) serving as a feed source of print medium 2 in the direction of conveyance of print medium 2, and "downstream" as situated farther from sheet feeder tray 11 in the direction of conveyance of print medium 2, when viewed from an arbitrary position. In addition, image formation section 3 corresponds to one concrete example of the "image formation section" of the invention. Furthermore, the description defines a conveyance direction as the direction in which print medium 2 moves, and refers to a direction orthogonal to the conveyance direction (a direction vertical to the sheet on which FIG. 1 is drawn) as transverse direction S. Moreover, the description defines a width as a dimension in transverse direction S.

(Configuration of Print Medium Feed Unit)

The print medium feed unit includes sheet feeder tray 11, feeder roller 12, feeder sub-roller (pickup roller) 13, separation roller 14, intermediate conveyance roller 15, pinch roller 16, registration roller 17, pressure roller 18, feed-in sensor 19 and write sensor 20.

Sheet feeder tray 11 is a member configured to contain stacked print media 2, and is also referred to as a sheet cassette. Sheet feeder tray 11 is detachably attached to a lower portion of image formation apparatus 1, for example.

Feeder roller 12, feeder sub-roller 13 and separation roller 14 are members (a sheet feeder mechanism) configured to separate print medium 2, which is situated uppermost in print media 2 contained in sheet feeder tray 11, from the rest of print media 2 on a one-by-one basis, to take out thus-separated print medium 2 sequentially, and to send print medium 2 to intermediate conveyance roller 15. Incidentally, separation piece 14A may be additionally provided downstream of feeder roller 12 and separation roller 14. This is because separation piece 14A enables print medium 2 situated uppermost in sheet feeder tray 11 to be securely separated from the other print media 2 situated thereunder.

Intermediate conveyance roller 15 and pinch roller 16 are members configured to work as a pair to hold therebetween print medium 2 sent by feeder roller 12, feeder sub-roller 13 and separation roller 14, and to convey print medium 2 to the downstream side. In addition, registration roller 17 and pressure roller 18 are members configured to work as a pair to hold therebetween print medium 2 conveyed by intermediate conveyance roller 15 and pinch roller 16, and to convey print medium 2 to the downstream side while correcting the skewed feeding of print medium 2.

Feed-in sensor 19 configured to detect the location of print medium 2 is provided upstream of registration roller 17 and pressure roller 18. Write sensor 20 configured to detect the location of print medium 2 so as to instruct image formation section 3 when to form an image on print medium 2 is provided downstream of registration roller 17 and pressure roller 18.

(Configuration of Image Formation Section 3)

Image formation section 3 forms a black image (toner image) on print medium 2, for example using a black toner (developer). It should be noted that: the color of the toner and the toner image is not limited to black; any arbitrary color may be used instead. Otherwise, color images (toner images) may be formed on print medium 2 using their respective color toners (developers).

Such toners are each made, for example, from a predetermined colorant, parting agent, electrification control agent, treatment agent and the like, which are mixed together or surface-treated as needed. Of these ingredients, the colorant, parting agent and electrification control agent function as internal additives. Silica, titanium oxide and the like, for example, are used as external additives. Polyester resin and the like, for example, are used as binding resins. In addition, dyes, pigments and the like may be used singly or in combination as the colorant.

As illustrated in FIG. 1, image formation section 3 includes toner cartridge (developer container) 21, image drum (referred as to as photosensitive drum or image carrier) 22, exposure head 23, transfer roller 24 and fuser unit 25.

Toner cartridge 21 is a container configured to contain a predetermined color toner. To put it concretely, toner cartridge 21 contains the black toner in the case of image formation section 3.

Image drum 22 is a member configured to carry an electrostatic latent image on its surface (the surface layer), and is made from photoreceptors (for example, organic photoreceptors). To put it concretely, image drum 22 includes an electrically-conductive support body, and a photoconductive layer covering the outer periphery (surface) of the electrically-conductive support body. The electrically-conductive support body is formed from a metal pipe made of aluminum, for example. The photoconductive layer has a structure in which charge generation layers and charge transport layers are sequentially stacked one after another. Incidentally, image drum 22 like this is configured to rotate at a predetermined peripheral speed, and is supplied with the black toner, for example, from toner cartridge 21. The black image (toner image) with the black toner adhering to the electrostatic latent image is formed on image drum 22.

Exposure head 23 is a device configured to expose the surface of image drum. 22 to light by irradiating the surface of image drum 22 with irradiation light, and thereby to form the electrostatic latent image on the surface (surface layer) of image drum 22. Exposure head 23 is formed, for example, from: light sources configured to emit the irradiation light; and a lens array configured to make an image on the surface of image drum 22 using the irradiation light. Incidentally, a light emitting diode (LED), a laser device or the like, for example, may be used as the light sources.

Transfer roller 24 is a member arranged opposite image drum 22, and configured to electrostatically transfer, for example, the black image (toner image) which is formed on image drum 22, onto print medium 2. Transfer roller 24 is made of foamed semiconductive elastic rubber material, for example.

Fuser unit 25 is a member configured to fix the toner (toner image) on print medium 2, which is conveyed from transfer roller 24, to print medium 2 by applying heat and pressure to the toner (toner image) on print medium 2. Fuser unit 25 includes heat roller 26 and pressure roller 27.

Heat roller 26 includes heater 26A, such as a halogen lamp, in its inside. Heat roller 26 applies heat to the toner on print medium 2.

Pressure roller 27 is a member (pressure roller) arranged in a way that a pressure contact portion is formed between pressure roller 27 and heat roller 26, and configured to apply pressure to the toner on print medium 2.

Image formation apparatus 1 further includes discharge sensor 28, discharge rollers 29, 30, pinch rollers 31, 32, and discharge tray 33 which are downstream of image formation section 3.

Discharge sensor 28 is a member configured to detect print medium 2 which is discharged from fuser unit 25. Discharge rollers 29, 30 are members arranged respectively opposite pinch rollers 31, 32, and configured to discharge print medium 2, on which fuser unit 25 fixes the toner, to discharge tray 33 outside image formation apparatus 1 with print medium 2 held between discharge roller 29, 30.

[Configuration of Main Part]

(Configuration of Sheet Feeder Unit 40)

Figure 2:
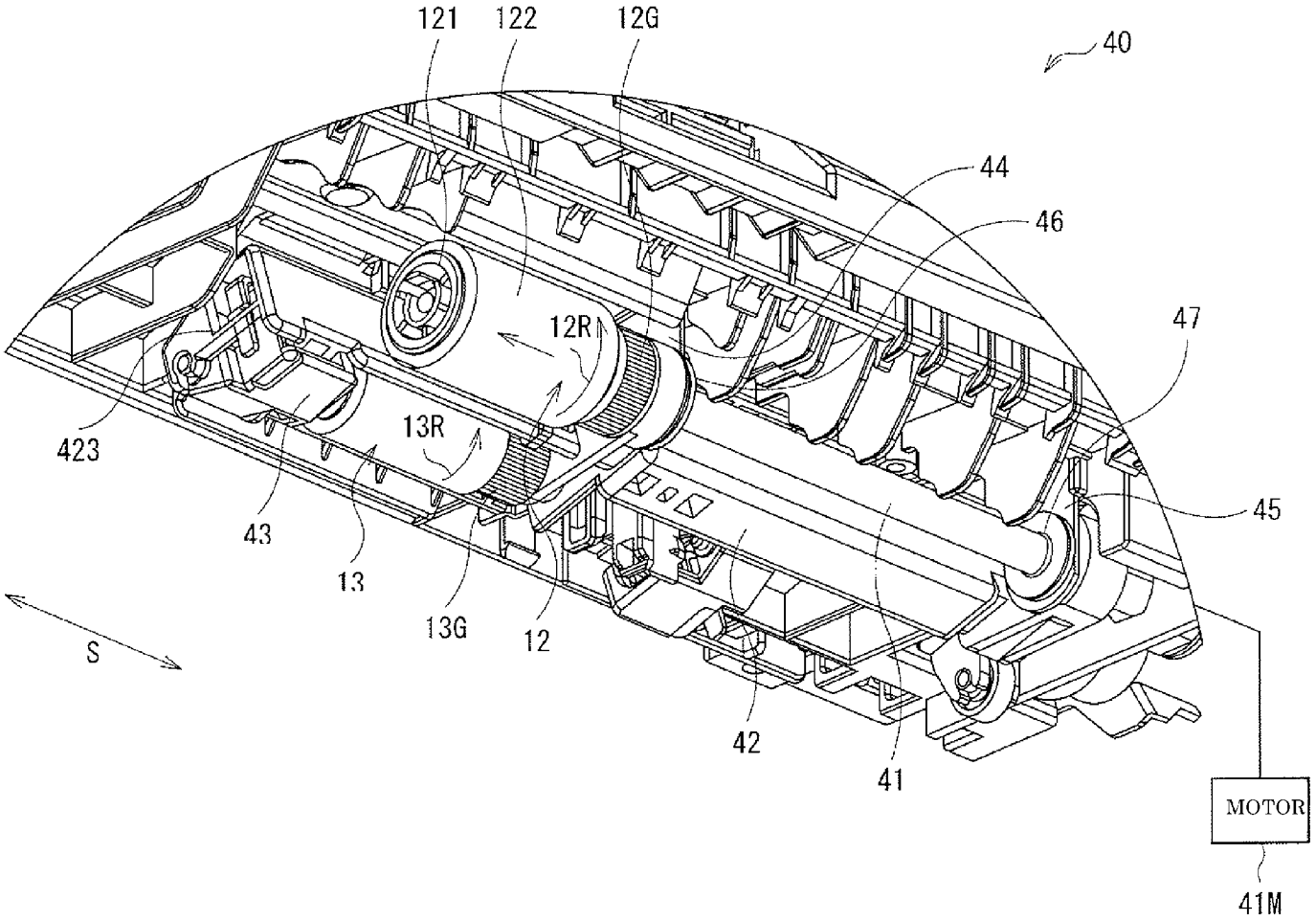
FIG. 2 is a perspective view illustrating a main part of the image formation apparatus illustrated in FIG. 1 in a magnified manner.

Next, referring to FIG. 2 and the like, descriptions are provided for a configuration of sheet feeder unit 40 including feeder roller 12 and feeder sub-roller 13, which is a main part of the print medium feed unit. FIG. 2 is a perspective view illustrating the main part of image formation apparatus 1 in a magnified manner.

Sheet feeder unit 40 corresponds to one concrete example of the "print medium feed unit" of the invention. Sheet feeder unit 40 includes feeder shaft 41, feeder frame 42, feeder sub-frame 43 and the like in addition to feeder roller 12 and feeder sub-roller 13 which are arranged adjacent to each other.

Feeder shaft 41 is, for example, a metal-made cylindrical member extending in a scan direction. A pair of bearings 46, 47 attached to a pair of frames 44, 45, which are uprightly provided to a main body of sheet feeder unit 40, rotatably supports feeder shaft 41. Gear 12G and feeder roller 12 are fixed to one end of feeder shaft 41. Motor 41M as the "power source" of the invention is directly or indirectly connected to the other end of feeder shaft 41. Thus, the drive force from motor 41M is configured to rotate feeder roller 12 together with feeder shaft 41 and gear 12G in the direction of arrow 12R.

Feeder roller 12 corresponds to one concrete example of the "second feed roller" of the invention. Feeder roller 12 functions to hold print medium 2, picked up by the rotation of feeder sub-roller 13, between feeder roller 12 and separation roller 14 on a one-by-one basis, and to send print medium 2 downstream by rotating in the direction of arrow 12R. Feeder roller 12 includes: shaft portion 121 shaped almost like a cylinder of a column with one end of shaft portion 121 fixed to feeder shaft 41; and elastic layer 122 continuously covering the periphery of shaft portion 121 in a rotational direction. Shaft portion 121 is made of resin, for example. Elastic layer 122 is made of elastic material, such as synthetic rubber, for example. Feeder roller 12 has a cantilever structure in which feeder roller 12 is supported at only one end, and the other end of feeder roller 12 is left open. This structure makes it possible to easily replace feeder roller 12 with a new one when feeder roller 12 deteriorates due to frictional wearing and the like of elastic layer 122 by use. Incidentally, metal-made feeder shaft 41 is strong enough for feeder shaft 41 to resist a biasing force of separation roller 14. In addition, since a light weight is achieved by making feeder shaft 41 from the metal and shaft portion 121 of feeder roller 12 from the resin, eccentricity (axial instability) of feeder roller 12 can be inhibited as well. If the pair of frames 44, 45 are made of metal, frames 44, 45 can have a higher strength, and accordingly, the eccentricity of feeder roller 12 can be further inhibited.

Figure 3:
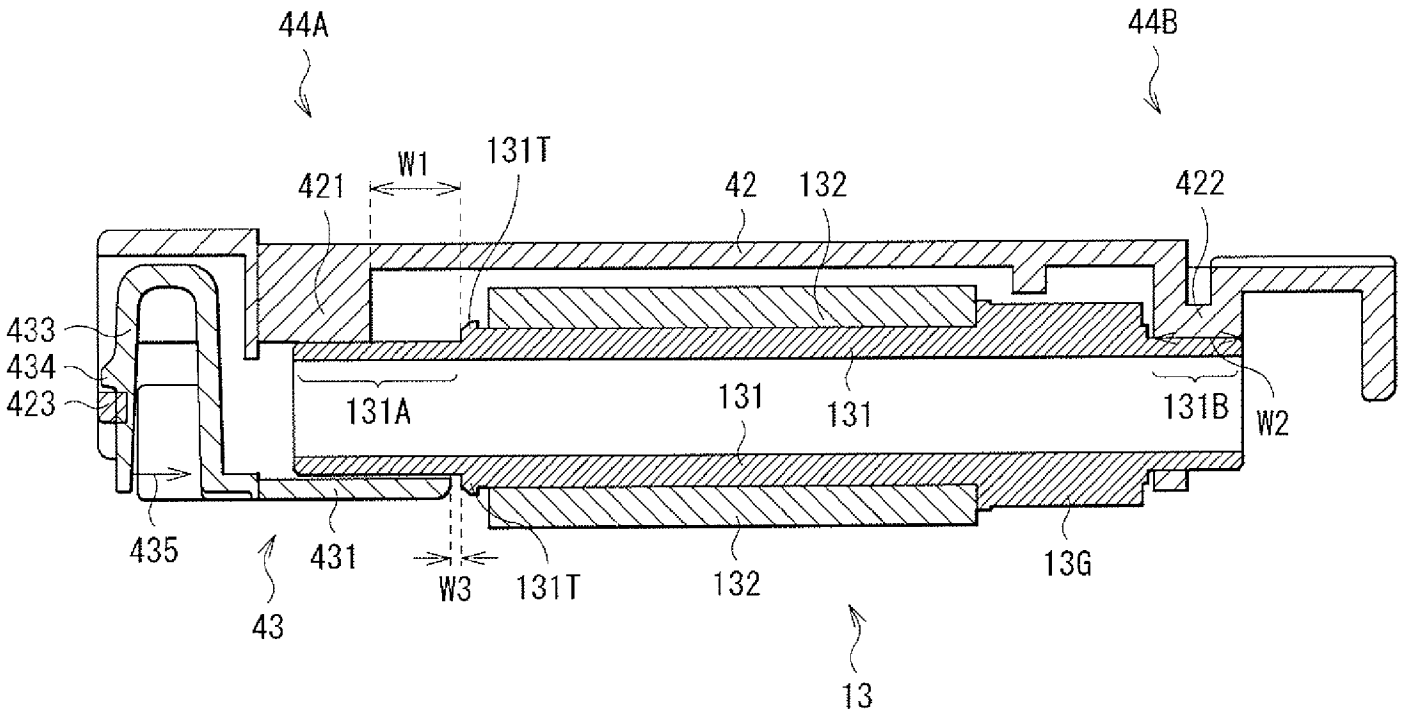
FIG. 3 is a cross-sectional view illustrating the main part of the image formation apparatus illustrated in FIG. 1 in a magnified manner.
Figure 4A:
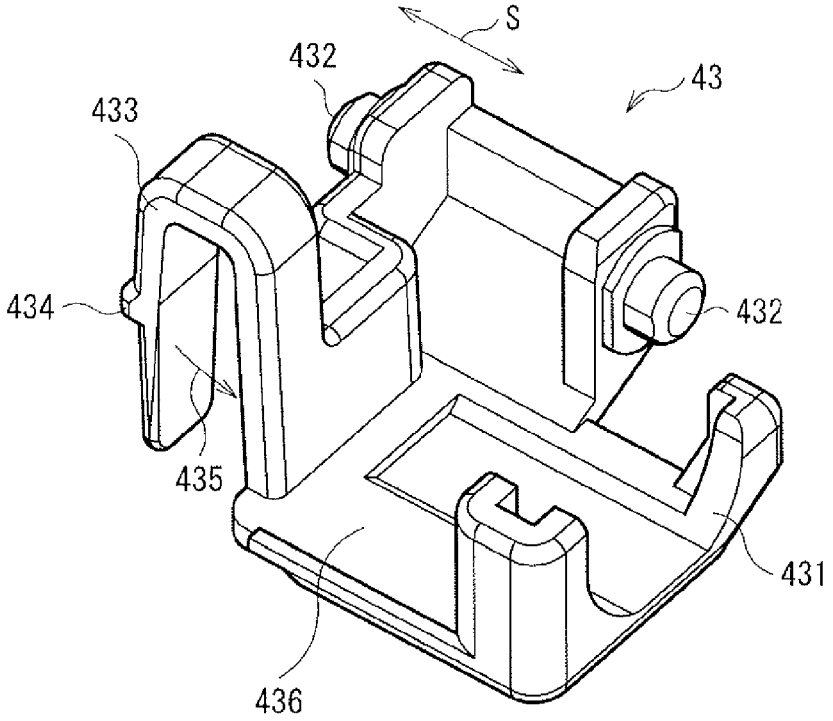
FIGS. 4A and 4B are perspective views illustrating in a magnified manner a component included in the main part of the image formation apparatus illustrated in FIG. 1.
Figure 4B:
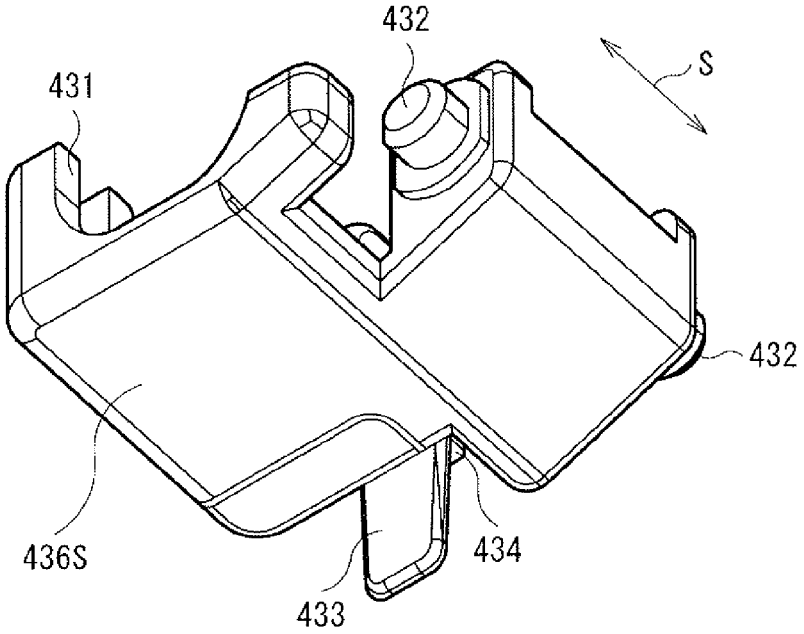
Figure 5A:
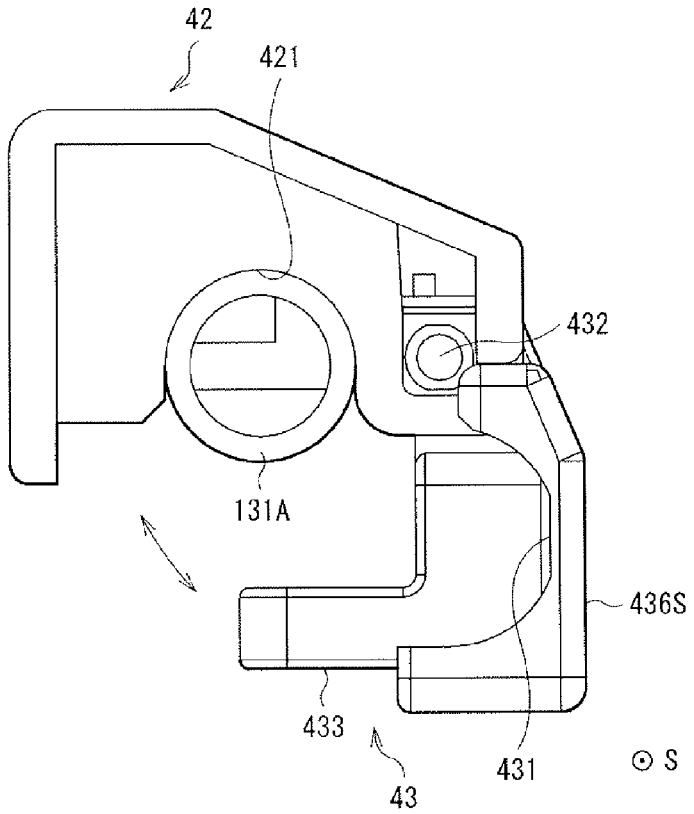
FIGS. 5A and 5B are side views illustrating in a magnified manner actions of components included in the main part of the image formation apparatus illustrated in FIG. 1.
Figure 5B:
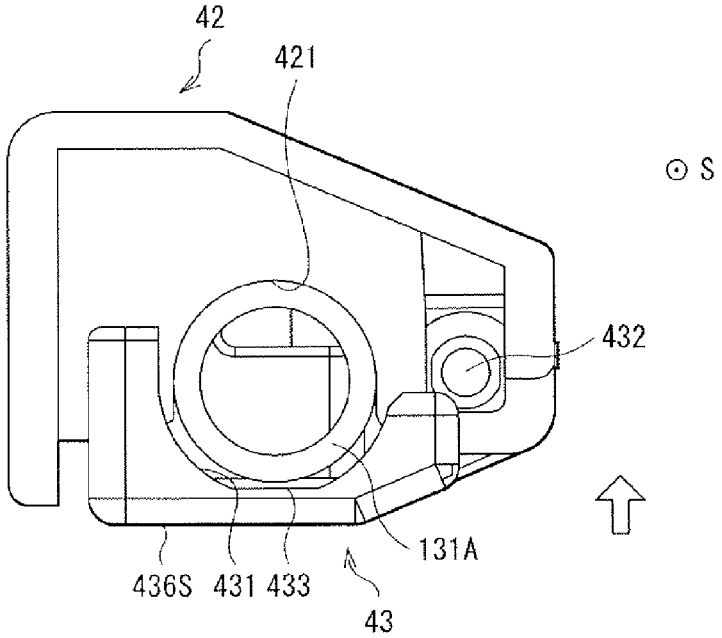
Figure 6:
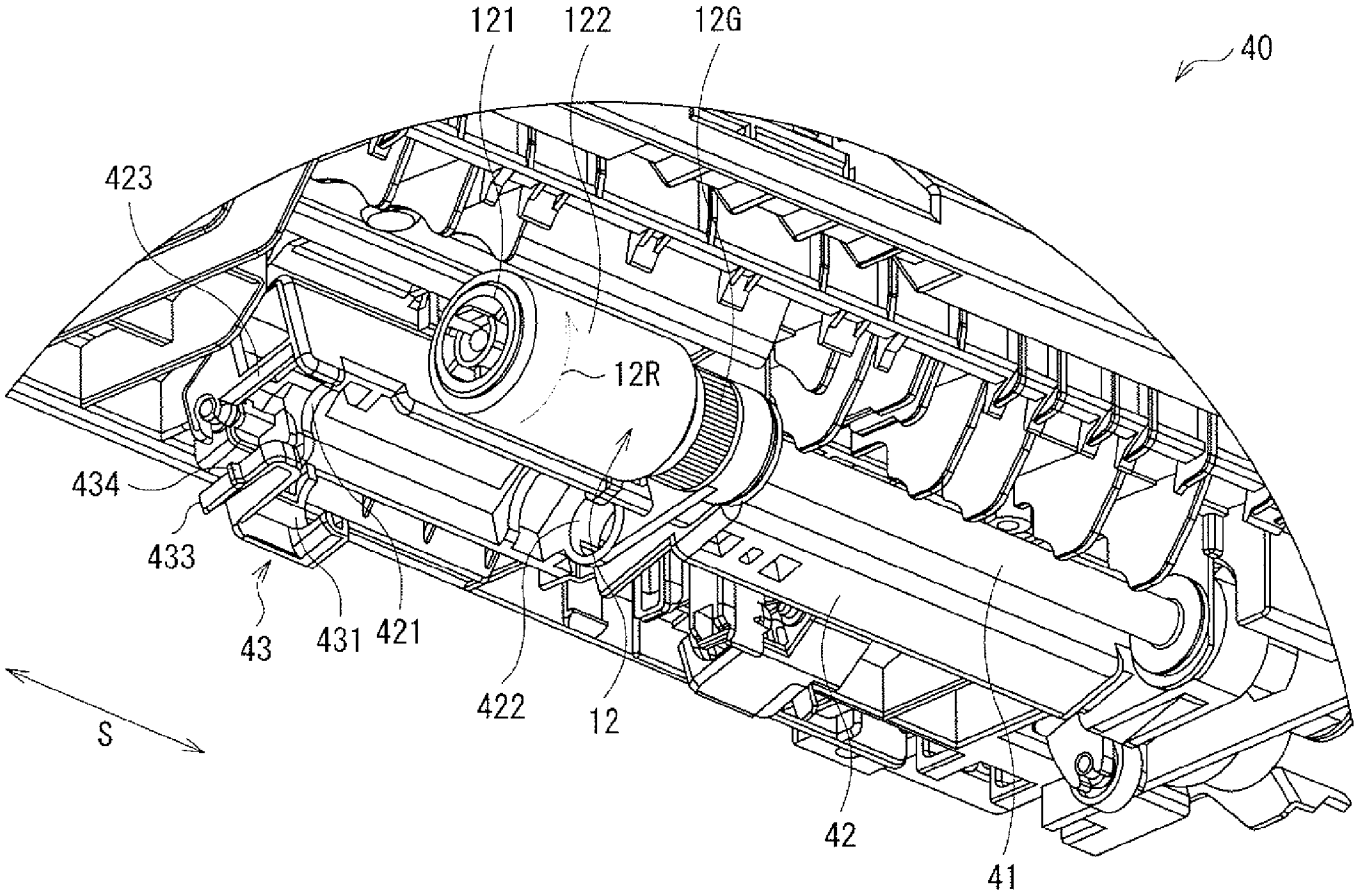
FIG. 6 is a magnified perspective view of the main part of the image formation apparatus illustrated in FIG. 1 with a part detached from the main part.

Referring to FIGS. 3 to 6 in addition to FIGS. 1 and 2, detailed descriptions are provided for feeder sub-roller 13, feeder frame 42 and feeder sub-frame 43. FIG. 3 is a cross-sectional view illustrating feeder sub-roller 13 and its vicinities in a magnified manner. FIGS. 4A and 4B are perspective views illustrating feeder sub-frame 43 in a magnified manner. FIGS. 5A and 5B are side views illustrating feeder frame 42 and feeder sub-frame 43 in a magnified manner. Furthermore, FIG. 6 is a perspective view illustrating feeder frame 42 with feeder sub-roller 13 detached.

Feeder sub-roller 13 corresponds to one concrete example of the "first feed roller" of the invention. Feeder sub-roller 13 is supported at the two ends by feeder frame 42 and feeder sub-frame 43, which constitute parts of the main body of sheet feeder unit 40, in a way that feeder sub-roller 13 is rotatable about transversely-extending rotation axis 13J in the direction of arrow 13R. Feeder sub-roller 13 includes: resin-made shaft portion 131 shaped almost like a cylinder or a column; and elastic layer 132 continuously covering the periphery of shaft portion 131 in the rotational direction. Elastic layer 132 is made of elastic material, such as synthetic rubber, for example. The outer peripheral surface of elastic layer 132 is in contact with print medium 2. Shaft portion 131 corresponds to one concrete example of the "shaft portion" of the invention. Elastic layer 132 corresponds to one concrete example of the "elastic layer" of the invention. Feeder sub-roller 13 is a member configured to pick up print medium 2 on a one-by-one basis by its rotation about rotation axis 13J (see FIG. 1), and to send print medium 2 to feeder roller 12. The surface of elastic layer 132 of feeder sub-roller 13 is in contact with the upper surface of print medium 2 which is located uppermost in print media 2 contained in sheet feeder tray 11.

First support portion 44A rotatably supports one end portion 131A of shaft portion 131. One end portion 131A corresponds to one concrete example of the "first end portion" of the invention. First support portion 44A includes a separation structure formed from a part of feeder frame 42 and a part of feeder sub-frame 43 which are configured to be separable from each other in a radial direction of feeder sub-roller 13. In other words, feeder frame 42 and feeder sub-frame 43 have a structure in which feeder frame 42 and feeder sub-frame 43 are separable from each other in the radial direction of feeder sub-roller 13. In this respect, the "separation" is not limited to a state where feeder frame 42 and feeder sub-frame 43 are physically out of contact with each other, or completely away from each other. That is to say, the concept of the "separation" includes a state where a part of feeder frame 42 and a part of feeder sub-frame 43 are in contact with each other while the other part of feeder frame 42 and the other part of feeder sub-frame 43 are away from each other. To put it concretely, as illustrated in FIGS. 5A and 5B, for example, feeder sub-frame 43 is configured to be turnable relative to feeder frame 42 about turn axis 432 extending in transverse direction S. The description defines an open state as a state where, as illustrated in FIG. 5A, feeder sub-frame 43 is away from one end portion 131A of shaft portion 131. On the other hand, the description defines a closed state as a state where, as illustrated in FIG. 5B, one end portion 131A is held between feeder frame 42 and feeder sub-frame 43.

Feeder frame 42 includes bearing portion 421 curving in the shape of almost the letter U along the outer peripheral surface of feeder sub-roller 13 in a rotational plane virtually orthogonal to transverse direction S (see FIG. 5B and FIG. 6). In addition, at a location varying in transverse direction S from that of bearing portion 421, feeder sub-frame 43 includes bearing portion 431 curving in the shape of almost the letter U along the outer peripheral surface of feeder sub-roller 13 in the rotational plane (see FIG. 3 and FIG. 5B). For example, bearing portion 431 is located between bearing portion 421 and elastic layer 132 in transverse direction S. One end portion 131A of feeder sub-roller 13 is rotatably held between bearing portion 421 and bearing portion 431. In this respect, as illustrated in FIG. 5B, first support portion 44A rotatably supports one end portion 131A of feeder sub-roller 13, with the two ends of bearing portion 421 respectively overlapping the two ends of bearing portion 431 when viewed in transverse direction S.

It should be noted that: feeder frame 42 corresponds to one concrete example of the "first part" of the "separation structure" of the invention; and feeder sub-frame 43 corresponds to one concrete example of the "second part" of the "separation structure" of the invention. In addition, bearing portion 421 corresponds to one concrete example of the "first curve portion" of the invention, and bearing portion 431 corresponds to one concrete example of the "second curve portion" of the invention.

Meanwhile, second support portion 44B formed from bearing portion 422 of feeder frame 42 rotatably supports other end portion 131B of shaft portion 131 (see FIG. 3). Bearing portion 422 of feeder frame 42 is an opening having a circular plane shape, into which other end portion 131B of shaft portion 131 is inserted (see FIG. 6). It should be noted that other end portion 131B corresponds to one concrete example of the "second end portion" of the invention.

In addition, gear 13G is formed on the outer peripheral surface of shaft portion 131 between a part of the outer peripheral surface, which is covered with elastic layer 132, and other end portion 131B. Feeder roller 12 and feeder sub-roller 13 are configured to synchronously rotate in the same direction while rotating about rotation axes 12J, 13J extending in transverse direction S, respectively. For example, the drive force from motor 41M is configured to be transmitted from gear 12G to gear 13G via idler gears 34.

Feeder frame 42 further includes lock portion 423. Lock portion 423 is configured to be locked to protrusion 434 of lever 433 in feeder sub-frame 43. Lever 433 is, for example, a U-shaped part of feeder sub-frame 43 curving in a plane in parallel with transverse direction S, and is reversibly shifted in the direction of arrow 435 when an external force is applied to lever 433.

As illustrated in FIGS. 4A and 4B, feeder sub-frame 43 further includes main body portion 436 including facing surface 436S which faces print medium 2. Lever 433 is provided to one end portion of main body portion 436 in transverse direction S, while bearing portion 431 is provided to the other end portion of main body portion 436 in transverse direction S. During the print operation, main body portion 436 is located between feeder frame 42 and print medium 2. Main body portion 436 is configured to be turnable about turn axis 432 in a way that main body portion 436 goes away from feeder frame 42.

Figure 7:
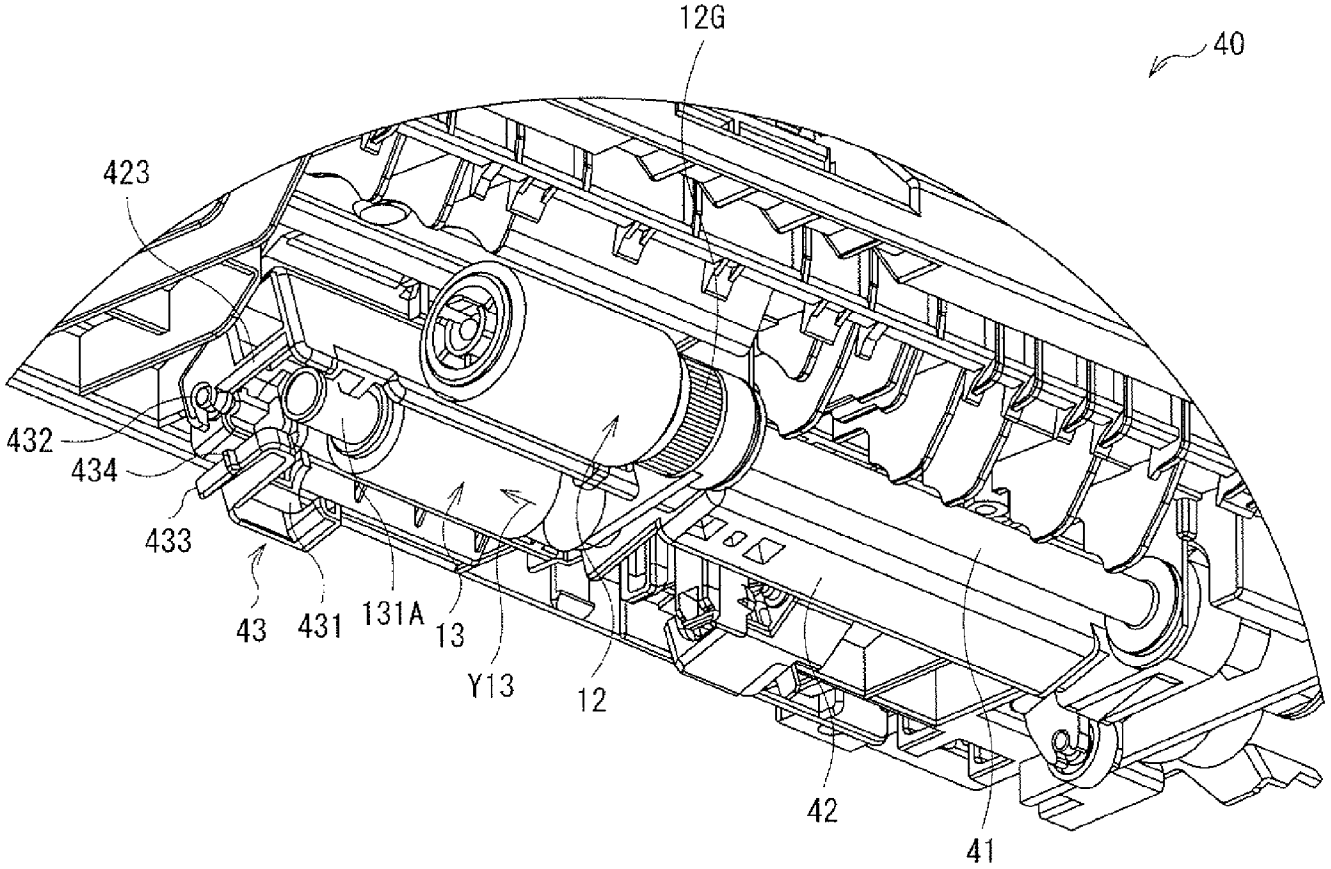
FIG. 7 is a main part magnified perspective view for explaining how to detach a first feed roller from the image formation apparatus illustrated in FIG. 1.
Figure 8A:
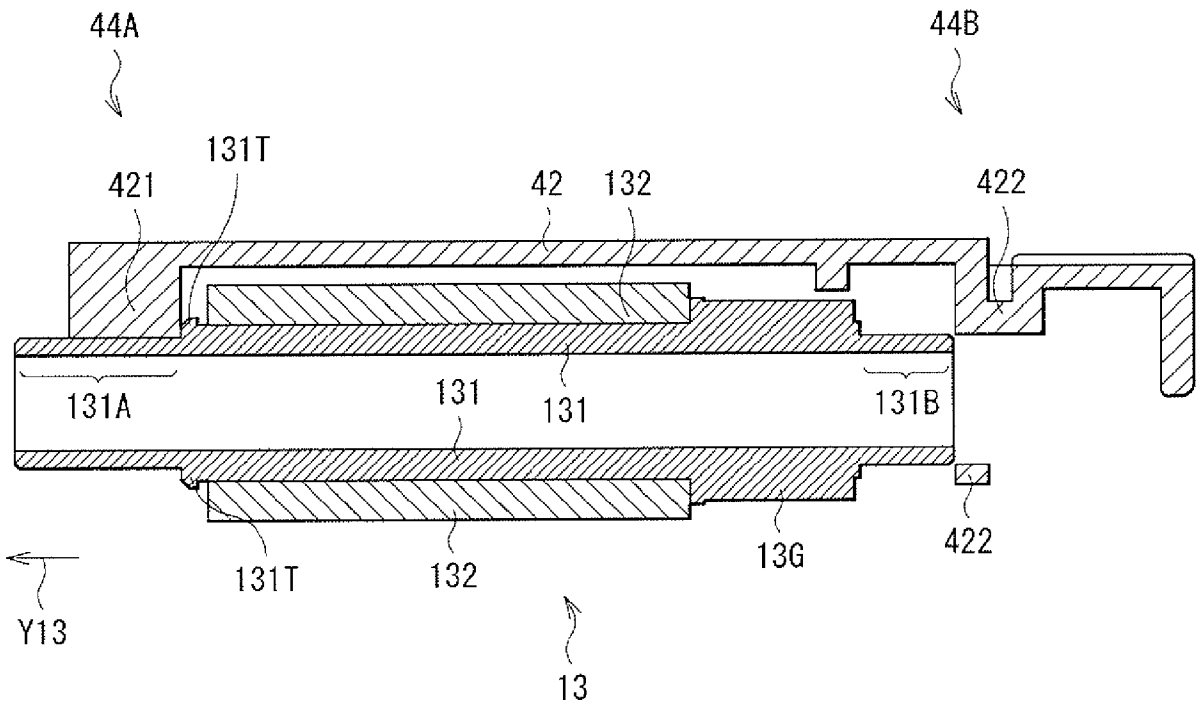
FIG. 8A is a main part magnified perspective view for explaining how to detach the first feed roller from the image formation apparatus illustrated in FIG. 1.
Figure 8B:
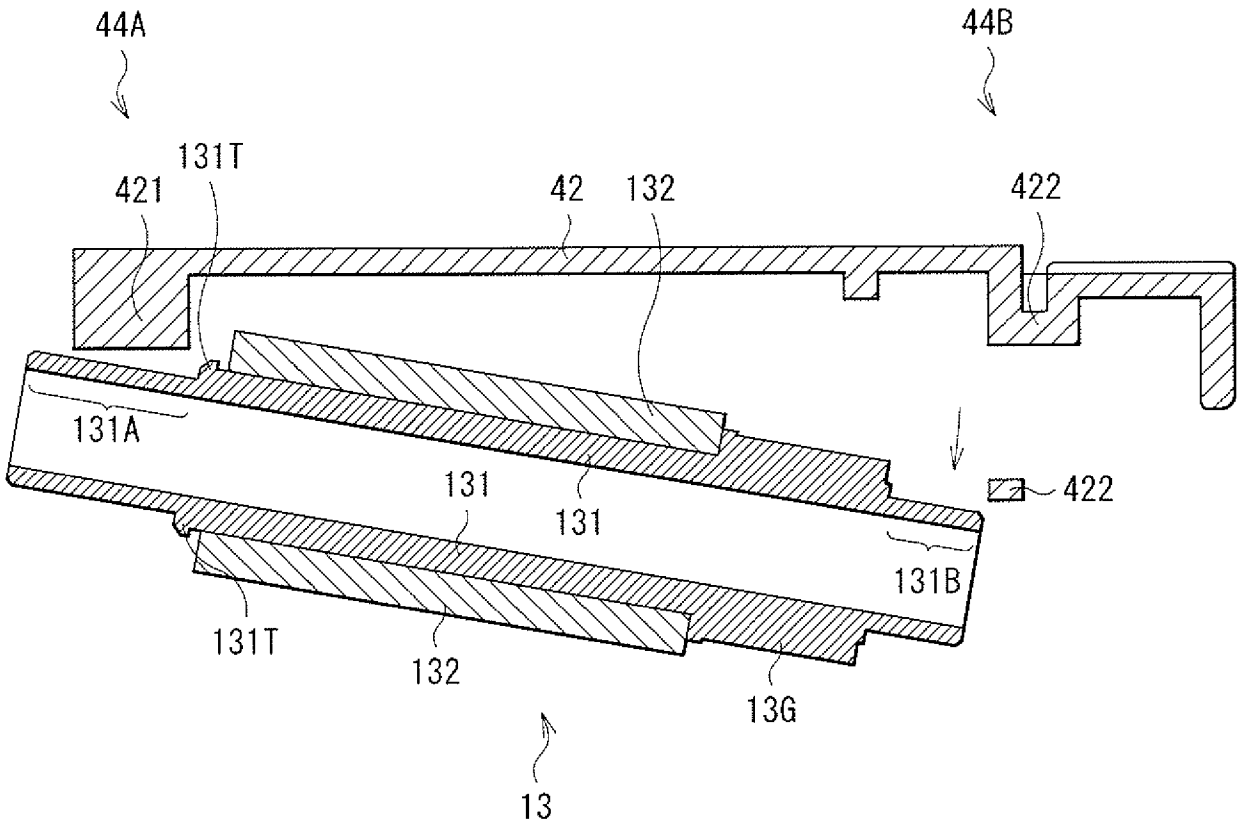
FIG. 8B is another main part magnified perspective view for explaining how to detach the first feed roller from the image formation apparatus illustrated in FIG. 1.

Furthermore, feeder frame 42 and feeder sub-frame 43 are configured, in the open state where bearing portion 431 is away from feeder sub-roller 13, to allow feeder sub-roller 13 to slide in transverse direction S until other end portion 131B of feeder sub-roller 13 comes off bearing portion 422. In other words, as illustrated in FIG. 3, width W2 of the largest play portion in one end portion 131A is larger than width W1 of other end portion 131B to be inserted in bearing portion 422. Width W2 represents a distance between bearing portion 421 and protrusion 131T provided to the outer peripheral surface of shaft portion 131. For this reason, as illustrated in FIG. 5A and FIG. 7, for example, when the state (open state) where bearing portion 431 is away from one end portion 131A is established by turning feeder sub-frame 43, feeder sub-roller 13 is slidable in the direction of arrow Y13 along transverse direction S. In this respect, if as illustrated in FIG. 8A, feeder sub-roller 13 is slid until protrusion 131T comes into contact with bearing portion 421, other end portion 131B comes off bearing portion 422. Thereby, as illustrated in FIG. 8B, feeder sub-roller 13 can be detached. Meanwhile, width W3 is narrower than width W2 (FIG. 3). For this reason, when the state (closes state) where one end portion 131A is held between feeder frame 42 and feeder sub-frame 43 is established, protrusion 131T comes into contact with bearing portion 431 before other end portion 131B comes off bearing portion 422. Accordingly, feeder sub-roller 13 is not detached.

[Working-Effects]

(A. Basic Action)

Image formation apparatus 1 transfers the toner image onto print medium 2, as follows.

To put it concretely, as illustrated in FIG. 1, first of all, feeder sub-roller 13 picks up uppermost print medium 2 from print media 2 contained in sheet feeder tray 11 on a one-by-one basis, and sends print medium 2 to downstream feeder roller 12. Subsequently, feeder roller 12 and separation roller 14 correct any skewed feeding of print medium 2 sent from feeder sub-roller 13. Thereafter, print medium 2 moves to intermediate conveyance roller 15 and pinch roller 16. Print medium 2 passes intermediate conveyance roller 15 and pinch roller 16, and reaches registration roller 17 and pressure roller 18. Afterward, registration roller 17 and pressure roller 18 convey print medium 2 to downstream image formation section 3 while correcting any skewed feeding of print medium 2. Image formation section 3 transfers the toner image onto print medium 2, as follows.

Image formation section 3 forms the black toner image through the following electrophotographic process. As illustrated in FIG. 1, first of all, a charging roller (not illustrated) supplied with a predetermined application voltage electrically charges the surface (surface layer portion) of image drum 22 evenly. Subsequently, exposure head 23 emits the irradiation light to the surface of image drum 22, and the surface of image drum 22 is thus exposed. Thereby, depending on the print pattern, the electrostatic latent image is formed on image drum 22. Furthermore, a development roller (not illustrated) makes the toner adhere to the electrostatic latent image on image drum 22. An electric field between image drum 22 and transfer roller 24 transfers the toner (toner image) on image drum 22 onto print medium 2.

After that, fuser unit 25 fixes the toner (toner image) onto print medium 2 by applying heat and pressure to the toner (toner image) on print medium 2. Subsequently, discharge rollers 29, 30 and the like discharge print medium 2, onto which the toner is fixed, to discharge tray 33 outside image formation apparatus 1.

(B. Work of Replacing Feeder Sub-Roller 13)

Here, descriptions are provided for how to replace feeder sub-roller 13 in image formation apparatus 1 of the embodiment. The replacement of feeder sub-roller 13 starts with turning off the power supply of the main body. Thereafter, sheet feeder tray is completely pulled out of housing 10. Thereby, as illustrated in FIG. 2, feeder sub-roller 13 becomes visible from the outside. Subsequently, as illustrated in FIG. 7, feeder sub-frame 43 is turned about turn axis 432, and first support portion 44A is put into the open state. Afterward, feeder sub-roller 13 is slid in the direction of arrow Y13. In this process, as illustrated in FIG. 8A, feeder sub-roller 13 is slid until protrusion 131T comes into contact with bearing portion 421. Thereby, other end portion 131B can be pulled out of bearing portion 422, and feeder sub-roller 13 can be taken out as illustrated in FIG. 8B.

(C. Effects)

As described above, in the embodiment, first support portion 44A, configured to rotatably support one end portion 131A of feeder sub-roller 13, has the separation structure in which feeder roller 12 and feeder sub-frame 43 are separable from each other in the radial direction of feeder sub-roller 13. The separation structure achieves both the operation of appropriately sending print medium 2 during the print operation and the work of easily replacing feeder sub-roller 13. This is because the supporting of feeder sub-roller 13 at the two ends makes it possible to support feeder sub-roller 13 more stably than the supporting of feeder sub-roller 13 at one end. In addition, the employment of the separable structure of first support portion 44A makes it possible to detach and attach feeder sub-roller 13 easily and simply.

Furthermore, the supporting of feeder sub-roller 13 at the two ends makes it possible to make feeder sub-roller 13 smaller in size and lighter in weight by: using material with a low specific gravity, such as resin, for shaft portion 131; and decreasing the diameter of shaft portion 131. If feeder sub-roller 13 were supported at one end, it is desirable that the shaft portion be made of a high-rigidity material, such as metal, and have a larger diameter for the purpose of inhibiting the eccentricity (axial instability) of the shaft portion which results from the deformation and flexure. In contrast, the supporting of feeder sub-roller 13 at the two ends in the embodiment makes it possible to distribute the load, which is applied to shaft portion 131, to one end portion 131A and other end portion 131B. For this reason, despite the decrease in the diameter of shaft portion 131 and in the rigidity of shaft portion 131 due to the use of resin, the embodiment can hold the position of rotation axis 13J appropriately, and can prevent the skewed feeding of print medium 2.

Moreover, the embodiment locates bearing portion 421 of feeder frame 42 and bearing portion 431 of feeder sub-frame 43 at their respective locations which vary from each other in transverse direction S, and makes bearing portion 421 and bearing portion 431 hold one end portion 131A of feeder sub-roller 13 between themselves in their respective opposite directions. In this respect, bearing portion 421 and bearing portion 431 both curve in the shape of almost the letter U along the outer peripheral surface of feeder sub-roller 13. In addition, the embodiment makes the two ends of bearing portion 421 respectively overlap the two ends of bearing portion 431 when viewed in transverse direction S. This makes it possible to support one end portion 131A of feeder sub-roller 13 more stably using first support portion 44A. As a result, the embodiment can fully inhibit any backlash of feeder sub-roller 13, and accordingly can achieve a more stable movement of print medium 2. Particularly since bearing portion 431 is arranged between elastic layer 132 and bearing portion 421 of feeder frame 42 which includes bearing portion 422 configured to support other end portion 131B, the embodiment can effectively inhibit the backlash of feeder sub-roller 13.

On the other hand, since second support portion 44B formed from bearing portion 422 as the opening rotatably supports other end portion 131B of feeder sub-roller 13, the embodiment can support other end portion 131B more stably while reducing the number of components.

In addition, the embodiment performs the opening and closing operation of feeder sub-frame 43 by locking protrusion 434 of lever 433 to lock portion 423 of feeder frame 42, and unlocking protrusion 434 of lever 433. This makes it possible to detach and attach feeder sub-roller 13 easily. In this respect, lever 433 is reversibly shifted in transverse direction S. In other words, lever 433 is shifted in the direction orthogonal to the plane in which bearing portion 431 curves (the rotational plane of feeder sub-roller 13). For this reason, any influence of the shift on a change in the shape of bearing portion 431 is small. Accordingly, bearing portion 431 is not deformed. Thereby, bearing portion 431 can stably support feeder sub-roller 13 no matter how many times feeder sub-frame 43 is repeatedly opened and closed.

Besides, the embodiment locates main body portion 436 of feeder sub-frame 43 between feeder frame 42 and print medium 2 while in the closed state. For this reason, during the print operation, the load applied to feeder sub-roller 13 in contact with print medium 2 is applied chiefly to bearing portions 421, 422 of feeder frame 42 provided to the main body of sheet feeder unit 40. Thereby, the embodiment achieves a more stable movement of print medium 2 during the print operation.

2. Modifications

The foregoing descriptions are provided for the invention by citing the embodiment. However, the invention is not limited to the foregoing embodiment. Various modifications may be made to the invention. For example, although the foregoing embodiment describes the image formation apparatus configured to transfer only the black toner image, and thus to form the monochrome image, the invention is not limited to this case. The invention is applicable to an image formation apparatus configured to form a multi-color image. In this case, such an image formation apparatus is configured to use color toners, and to include image formation sections configured to form the respective toner images. Furthermore, although the embodiment describes image formation apparatus 1 for the primary transfer process, the invention is applicable to an image formation apparatus for the secondary transfer process as well.

Figure 9:
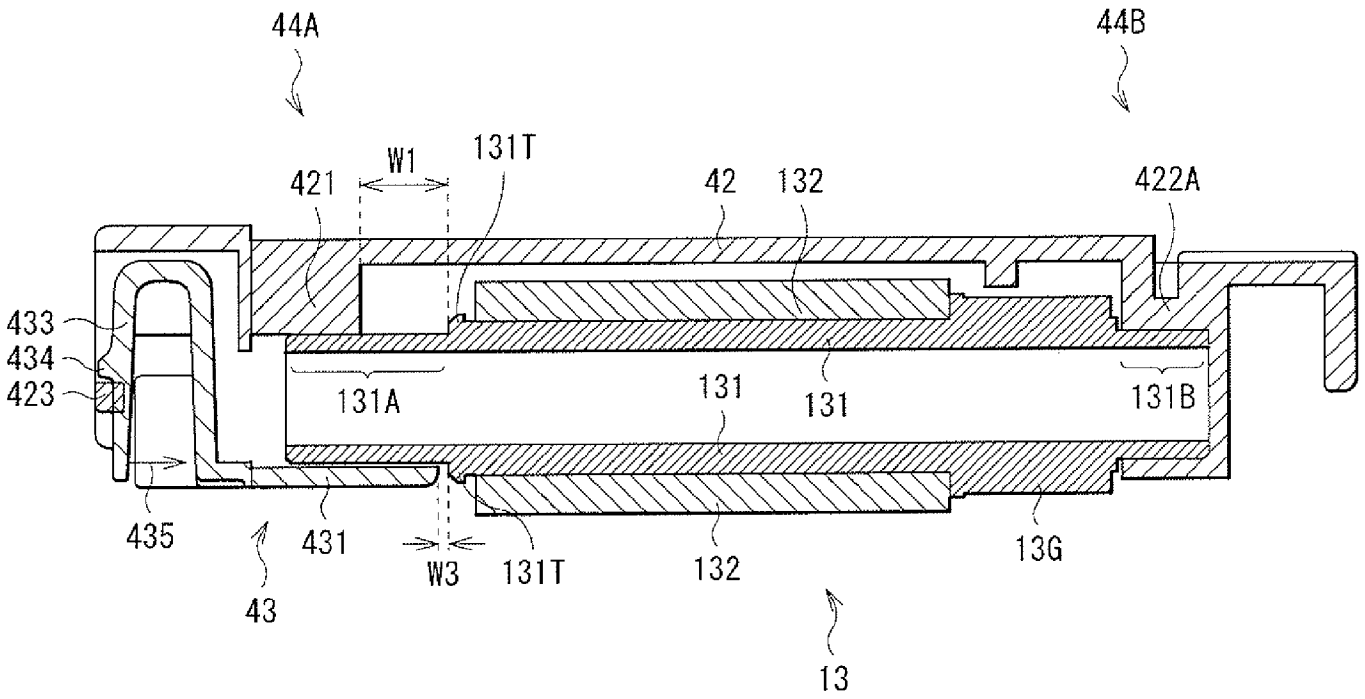
FIG. 9 is a magnified cross-sectional view illustrating a main part of a modification of an image formation apparatus.

In addition, although the foregoing embodiment forms bearing portion 422 of feeder frame 42 as the opening (through-hole) through which to insert other end portion 131B of shaft portion 131, the invention is not limited to this case. For example, as illustrated in FIG. 9, the invention may be such that: bearing portion 422A formed from a recessed portion is used instead of bearing portion 422; and a part of other end portion 131B of shaft portion 131 is settled in bearing portion 422A.

Furthermore, although the foregoing embodiment is provided with feeder roller 12 and feeder sub-roller 13 for their individual functions, a single roller may perform the two functions.

Moreover, although the foregoing embodiment is configured such that only first support portion 44A employs the separation structure while second support portion 44B is formed from bearing portion 422 as the opening, the invention is not limited to this case. For example, second support portion 44B may have the separation structure. Otherwise, both first support portion 44A and second support portion 44B may have the separation structure. Besides, although the foregoing embodiment uses feeder frame 42 commonly for both first support portion 44A and second support portion 44B, first support portion 44A and second support portion 44B may be formed from their respective frames.

In addition, although the foregoing embodiment uses the LED head, which has the light-emitting diode as the light source, as the exposure device, the invention may instead use a laser device, for example, as the light source.

Furthermore, although the foregoing embodiment explains the image formation apparatus configured to perform the print function as the concrete example of the "image formation apparatus" of the invention, the invention is not limited to this case. In other words, the invention is applicable to an image formation apparatus configured to function as a multifunction machine configured to perform, for example, a scanner function and a facsimile function in addition to the print function.

What is claimed is:

1. A print medium feed unit comprising:

a first feed roller including a first end portion and a second end portion, and configured to pick up a print medium by rotating about a rotational axis extending in a first direction;

a first support portion configured to rotationally support the first end portion; and a second support portion configured to rotationally support the second end portion, wherein at least one of the first support portion and the second support portion includes a separation structure including a first portion and a second portion which are separable from each other in a radial direction of the first feed roller, the first portion includes a first curve portion curving along an outer peripheral surface of the first feed roller in a rotational plane substantially orthogonal to the first direction, the second portion includes a second curve portion curving along the outer peripheral surface of the first feed roller in the rotational plane, a location of the second curve portion varying in the first direction from that of the first curve portion, and the separation structure rotatably supports any one of the first end portion and the second end portion with two ends of the first curve portion respectively overlapping two ends of the second curve portion when viewed in the first direction.

2. The print medium feed unit according to claim 1, wherein the first support portion includes the separation structure configured to support the first end portion, and the second support portion includes any one of an opening and a recessed portion into which to insert the second end portion.

3. The print medium feed unit according to claim 2, wherein the separation structure is configured to, in a state where the second portion is away from the first feed roller, allow the first feed roller to slide in the first direction until the second end portion comes off the one of the opening and the recessed portion.

4. The print medium feed unit according to claim 2, wherein the second portion is configured to be turnable relative to the first portion about a turn axis extending in the first direction.

5. The print medium feed unit according to claim 4, wherein the first portion further includes a lock portion, and the second portion further includes a lever configured to be reversibly shifted in the first direction, and to be locked to the lock portion of the first portion.

6. The print medium feed unit according to claim 5, wherein the second portion further includes a main body portion including a surface which faces the print medium, the second curve portion is provided to one end portion of the main body portion, and the lever is provided to an opposite end portion of the main body portion.

7. The print medium feed unit according to claim 6, wherein the main body portion of the second portion is arranged between the first portion and the print medium, and is configured to be turnable about the turn axis such that the main body portion goes away from the first portion.

8. The print medium feed unit according to claim 1, further comprising a second feed roller located adjacent to the first feed roller, and configured to rotate in synchronization with rotation of the first feed roller.

9. The print medium feed unit according to claim 8, further comprising a drive source, wherein the second feed roller rotates using a drive force from the drive source, and the first feed roller rotates using the drive force from the drive source which is transmitted via the second feed roller.

10. The print medium feed unit according to claim 1, wherein the first feed roller includes a shaft portion whose two ends are supported by the first support portion and the second support portion, respectively, and an elastic layer covering an outer peripheral surface of the shaft portion between the first support portion and the second support portion.

11. An image formation apparatus comprising:

the print medium feed unit according to claim 1; and an image formation section configured to form an image on the print medium which is fed by the first feed roller of the print medium feed unit.

12. A print medium feed unit comprising:

a first feed roller including a first end portion and a second end portion, and configured to pick up a print medium by rotating about a rotational axis extending in a first direction;

a first support portion configured to rotationally support the first end portion; and a second support portion configured to rotationally support the second end portion, wherein at least one of the first support portion and the second support portion includes a separation structure including a first portion and a second portion which are separable from each other in a radial direction of the first feed roller, the first support portion includes the separation structure configured to support the first end portion, and the second support portion includes any one of an opening and a recessed portion into which to insert the second end portion, the second portion is configured to be turnable relative to the first portion about a turn axis extending in the first direction.

13. The print medium feed unit according to claim 12, wherein the first portion further includes a lock portion, and the second portion further includes a lever configured to be reversibly shifted in the first direction, and to be locked to the lock portion of the first portion.

14. The print medium feed unit according to claim 13, wherein the second portion further includes a main body portion including a surface which faces the print medium, the second curve portion is provided to one end portion of the main body portion, and the lever is provided to an opposite end portion of the main body portion.

15. The print medium feed unit according to claim 14, wherein the main body portion of the second portion is arranged between the first portion and the print medium, and is configured to be turnable about the turn axis such that the main body portion goes away from the first portion.

16. The print medium feed unit according to claim 12, wherein the separation structure is configured to, in a state where the second portion is away from the first feed roller, allow the first feed roller to slide in the first direction until the second end portion comes off the one of the opening and the recessed portion.

17. The print medium feed unit according to claim 12, further comprising a second feed roller located adjacent to the first feed roller, and configured to rotate in synchronization with rotation of the first feed roller.

18. The print medium feed unit according to claim 17, further comprising a drive source, wherein the second feed roller rotates using a drive force from the drive source, and the first feed roller rotates using the drive force from the drive source which is transmitted via the second feed roller.

19. The print medium feed unit according to claim 12, wherein the first feed roller includes a shaft portion whose two ends are supported by the first support portion and the second support portion, respectively, and an elastic layer covering an outer peripheral surface of the shaft portion between the first support portion and the second support portion.

20. An image formation apparatus comprising:

the print medium feed unit according to claim 13; and an image formation section configured to form an image on the print medium which is fed by the first feed roller of the print medium feed unit.

* * * * *